US007748330B2

(12) United States Patent
Dubois et al.

(10) Patent No.: US 7,748,330 B2
(45) Date of Patent: Jul. 6, 2010

(54) LARGE LOAD CARRIER

(75) Inventors: Jean-Marc Dubois, Bremgarten (SE); Jürgen Straub, Albershausen (DE); Christian Mathews, Weil der Stadt (DE); Thomas Feilner, Marktgröningen (DE)

(73) Assignee: Georg Utz Holding AG, Bremgarten (CH)

( * ) Notice: Subject to any disclaimer, the term of this patent is extended or adjusted under 35 U.S.C. 154(b) by 385 days.

(21) Appl. No.: 11/664,966

(22) PCT Filed: Sep. 27, 2005

(86) PCT No.: PCT/DE2005/001701

§ 371 (c)(1),
(2), (4) Date: Apr. 9, 2007

(87) PCT Pub. No.: WO2006/039886

PCT Pub. Date: Apr. 20, 2006

(65) Prior Publication Data

US 2009/0007824 A1 Jan. 8, 2009

(30) Foreign Application Priority Data

Oct. 8, 2004 (DE) ..... 10 2004 049 201

(51) Int. Cl.
*B65D 19/12* (2006.01)

(52) U.S. Cl. ..... 108/56.3; 108/187

(58) Field of Classification Search ..... 108/51.11, 108/56.3, 187, 155, 147.17; 312/351.3; 206/599, 206/386; 220/630, 628, 636; 248/346.02, 248/188.8, 188.9, 188.91

See application file for complete search history.

(56) References Cited

U.S. PATENT DOCUMENTS

| | | | | |
|---|---|---|---|---|
| 3,699,901 | A * | 10/1972 | Cook, III | 108/57.25 |
| 4,735,154 | A | 4/1988 | Hemery et al. | |
| 5,042,396 | A * | 8/1991 | Shuert | 108/57.25 |
| 5,269,230 | A * | 12/1993 | Nakamura | 108/56.3 |
| 5,868,080 | A | 2/1999 | Wyler et al. | |
| 6,719,164 | B2 * | 4/2004 | Maschio | 220/571 |
| 2004/0118325 | A1 | 6/2004 | Moore et al. | |

OTHER PUBLICATIONS

International Search Report.

* cited by examiner

*Primary Examiner*—Janet M Wilkens
*Assistant Examiner*—Dan Rohrhoff
(74) *Attorney, Agent, or Firm*—Collard & Roe, P.C.

(57) ABSTRACT

A heavy load support made of plastic includes at least a rectangular bottom part with a leg part into which the fork of a forklift engages and which is provided with props located at least in the four corner areas of the bottom part. Metallic U-shaped profiled rails that are open towards the outside are provided between the props along the bottom edge of the load support. The props can be removably fixed to the bottom face of the bottom part of the load support and are provided with a support area for the corner areas of the bottom part as well as an edge which rises vertically from the support area and encloses the edges of the load support at a right angle, pegs being molded onto the free final leg surfaces of the edge to accommodate and fix the U-shaped profiled strips.

10 Claims, 9 Drawing Sheets

LARGE LOAD CARRIER

CROSS REFERENCE TO RELATED APPLICATIONS

Applicants claim priority under 35 U.S.C. §119 of German Application No. 10 2004 049 201.8 filed on Oct. 8, 2004. Applicants also claim priority under 35 U.S.C. §365 of PCT/DE2005/001701 filed on Sep. 27, 2005. The international application under PCT article 21(2) was not published in English.

BACKGROUND OF THE INVENTION

1. Field of the Invention

The invention relates to a large load carrier made of plastic, in accordance with the preamble of claim 1.

2. Description of the Related Art

Such large load carriers are large space containers on a pallet base, or such pallets themselves. The containers exist in many variations, with closed side walls, with perforated side walls, with two or three runners, with rollers or feet.

In this connection, these heavy load containers or pallets can also be stacked, whereby the lowest container in the stack carries three to four tons.

For this reason, such a stack is not lifted and set down by the forklift truck driver. Instead, he moves the tines of the fork against the lower edge of the bottommost container or the bottommost pallet in the stack, and displaces the stack in this manner, to the desired location, over a hall floor that is generally rough.

In this connection, of course, damage or destruction of the plastic container or of the pallet frequently occurs in this region.

For this reason, the large load carriers in question have also already been set onto steel flat pallets, which consist of a metal frame provided with internal struts, of U profiles that point outward, and standing feet disposed in the corner regions of the frame, in such a manner that the U profiles surround the lower region of the container and are connected with it by means of attachment screws. The forklift truck driver therefore has the possibility of moving the tip of the fork into the U profile and, in this manner, displacing the plastic containers without the risk of damage to them.

However, such flat pallets are expensive to produce, bulky to store, and additionally increase the weight of the stack.

SUMMARY OF THE INVENTION

The invention is therefore based on the task of indicating an inexpensive alternative of a load carrier protection made of U profiles, which requires extremely little storage space and offers advantages in terms of weight.

The invention accomplishes this task in accordance with the characterizing part of claim 1, in that the feet can be releasably attached to the underside of the bottom part, have a contact surface for the corner regions of the load carrier bottom part, as well as a border that rises vertically from the contact surface, which border surrounds the load carrier edges at a right angle, on which pegs for accommodating the U-profile strips and fixing them in place are formed on at its free shank end surfaces.

This system makes it possible for the foot part to be put together from feet and U profiles, whereby this composite foot part can be attached to the load carrier bottom.

In the disassembled state, these foot parts take up very little storage space. Nevertheless, they offer the same protection during displacement of a load carrier stack as the steel flat pallets. Refitting to different foot variants are quickly possible.

As additional reinforcement of such a foot part that can be put together, it is provided, according to claim 2, that an accommodation and fixation element is provided for a reinforcement strip that reaches from one standing foot to the diagonally opposite standing foot and is recessed into a depression provided in the bottom part, in the form of a U profile, for example.

For this purpose, a bracket corresponding to the inside dimensions of the U profile is provided on the contact surface, onto which the U-profile strip is set.

In order to simplify the production of the feet and reduce their weight, claim 3 proposes that the load carrier feet are plastic injection-molded parts.

In order to protect these plastic feet against excessive wear during displacement, claim 4 proposes that a metal plate is mounted on the standing surface of the feet, in each instance.

However, it is also possible to form the standing feet entirely of metal, for example using the die-casting method, or also by means of cutting machining.

Claim 6 proposes that the standing feet can be screwed onto the underside of the load carrier bottom part. The foot can be installed with form fit with the contact surface and flush with the bottom surface of the load carrier, if this bottom surface is correspondingly lowered, according to claim 13.

In this way, crosswise forces are absorbed and the screws are relieved of stress. Furthermore, the fork of the forklift truck can be moved in without hindrance.

In a preferred embodiment of the invention, it is provided, according to claim 7, that the screw connection takes place through bores in the contact surface of the foot, which bores align with screw-on domes formed into the load carrier bottom part.

These screw-on domes are particularly implemented in load carrier bottoms that are configured in grid form or honeycomb form. Cylinder-shaped recesses are formed into several intersection points of such honeycomb-grid crosspieces, or into the crosspieces themselves, into which recesses self-tapping screws can be screwed.

If the container feet consist of plastic, it is proposed, according to claim 8, that a play of several millimeters (for example 5 mm) remains between the free shank end surfaces of the border and the face surfaces of the U-profile strips, in order to be able to balance out the different length expansion values of plastic and steel.

For the same reason, it is proposed, according to claim 9, that a play of several millimeters remains between the wall of the border that faces towards the load carrier, and the face surface of the reinforcement profile assigned to this wall.

According to claim 10, the contact surface of the standing foot is configured to be greater than the base surface of the standing foot itself, so that in this manner, a better force distribution between standing foot and load carrier exists.

The feet can also be connected with one another by means of runners, in this case, as in the case of known load carriers.

Load carriers are defined, according to the invention, as large space containers or as pallets (see claims 11 and 12).

BRIEF DESCRIPTION OF THE DRAWINGS

In the following, the invention will be presented and explained in greater detail using drawings.

These show.

DETAILED DESCRIPTION OF PREFERRED EMBODIMENTS

Figure 1:
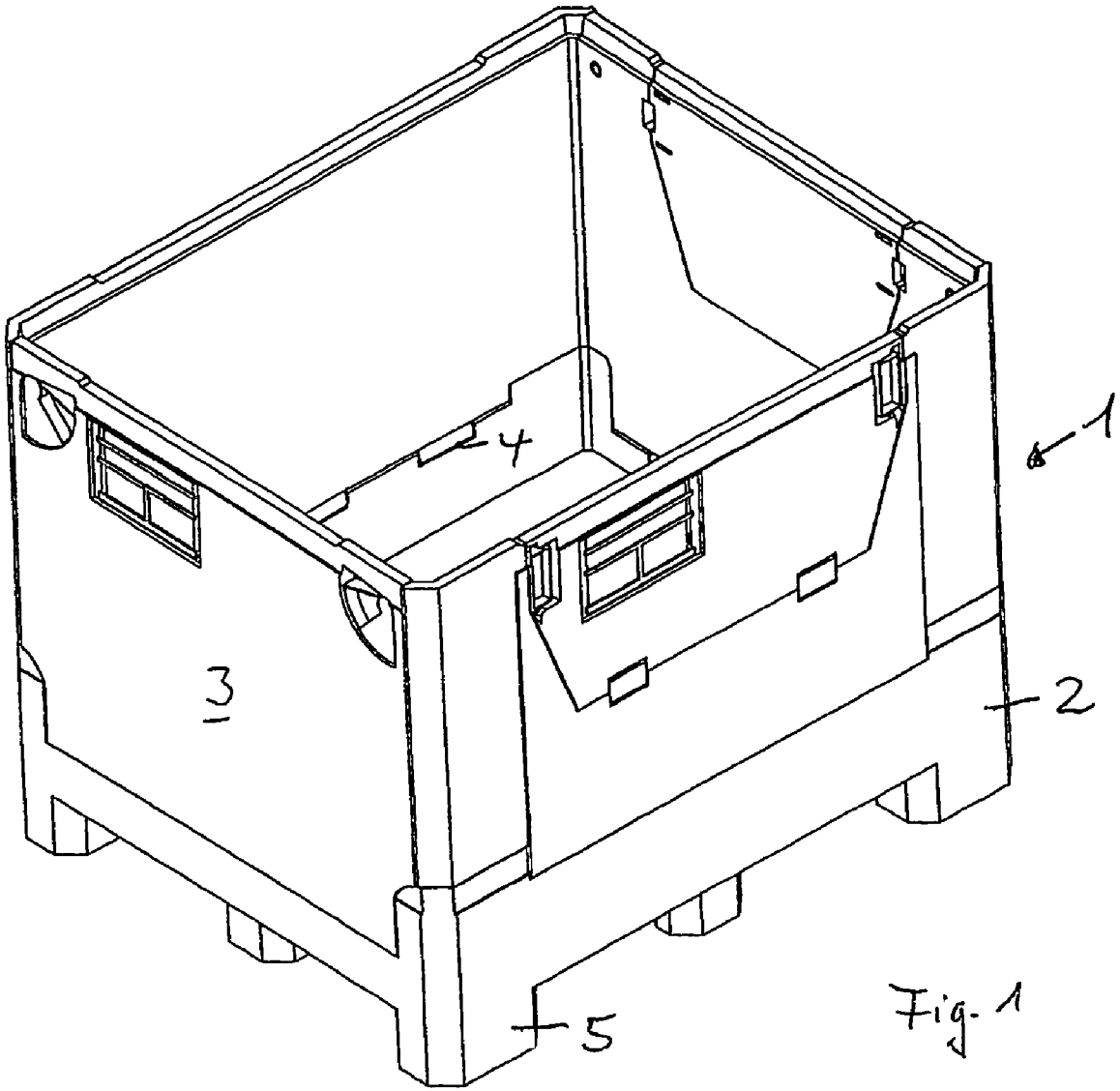
FIG. 1 a large space container according to the state of the art

In FIG. 1 a large space container made of plastic is shown and indicated in general with the reference symbol 1. In the present case, the large space container 1 on a pallet base 2 is a folding box, in which the side walls 3 can be folded inward, about hinges 4.

The pallet base, which is an integral part of the container 1, has standing feet 5, between which the fork of a forklift truck can be moved in.

The containers 1 are structured in such a manner that several can be stacked on top of one another, whereby the weight of such a stack can amount to several tons. For a forklift truck, it is practically impossible, in this case, to lift the stack in order to move its location, to move it, and to set it down again, for static reasons. For this reason, the forklift truck drivers set the tines of the fork of the forklift truck against the container 1 above the standing feet 5, and thereby displace the entire stack from one location to another. Since the previously known containers 1 consist of plastic, and the displacement movement generally takes place over a rough hall floor, the forks of the forklift trucks frequently cause damage or destruction of the containers 1 during this displacement process.

Figure 2:
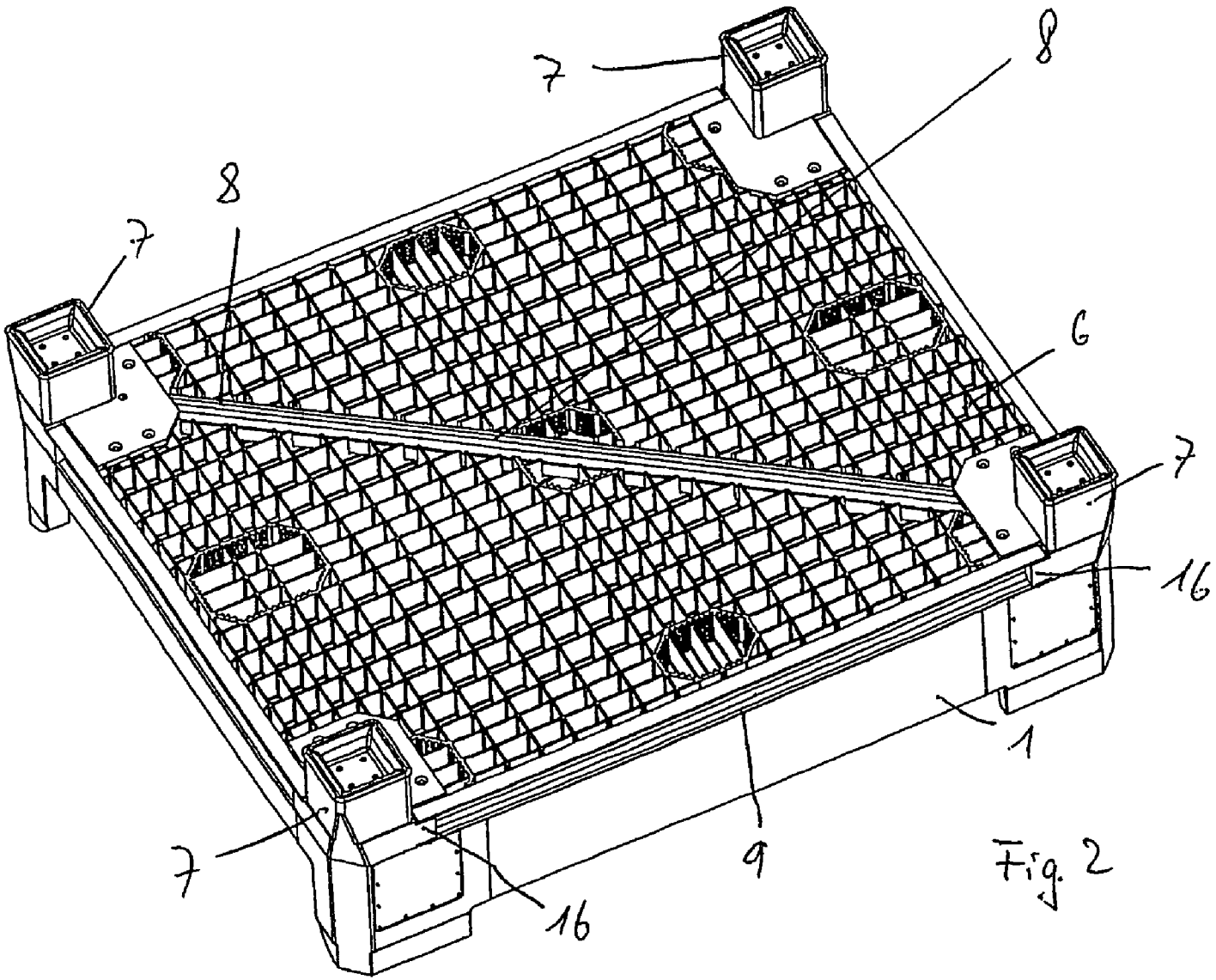
FIG. 2 lower part of a large space container according to the invention

According to FIG. 2, the lower part of a large space container is modified according to the invention. The actual container 1 (only the lower part is shown in FIG. 2) no longer has the integrated pallet base 2.

Figure 4:
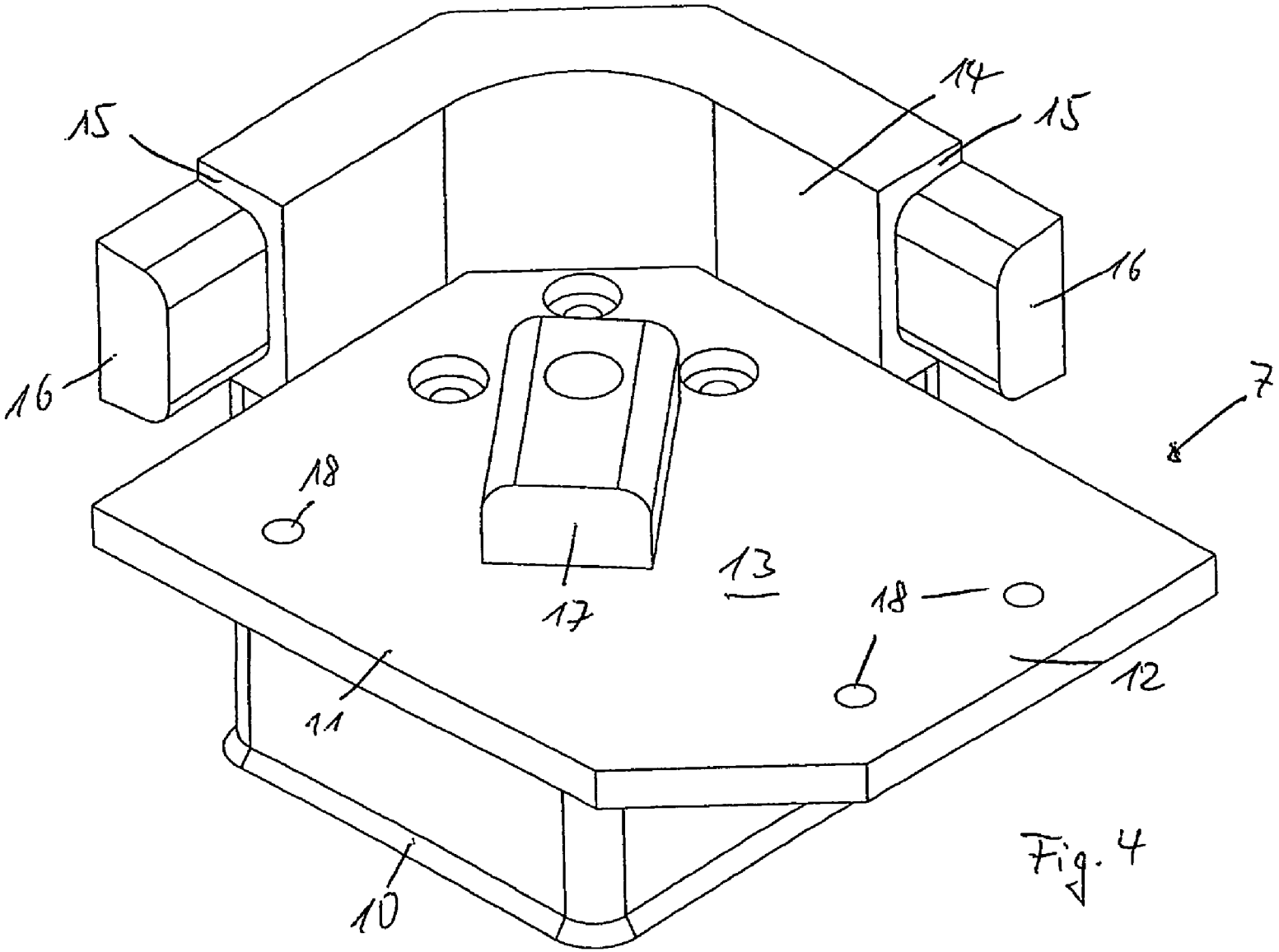
FIG. 4 standing foot in a perspective view, according to the invention

Standing feet 7 are screwed onto the container bottom 6 at the four corner regions; details of these are evident from FIG. 4.

The container bottom 6 is configured to be grid-shaped or honeycomb-shaped, for reinforcement reasons. A reinforcement strip 8 made of metal, configured as a U profile, is inserted into a depression in the container bottom 6, between two standing feet 7 that lie diagonally opposite one another.

On the side edges of the container 1, there are U-profile strips 9 made of steel, between the standing feet 7, whereby the opening of the U points outward.

The U-profile strips 9 fulfill the function of serving as engagement surfaces for the tines of the fork of a forklift truck.

Figure 3:
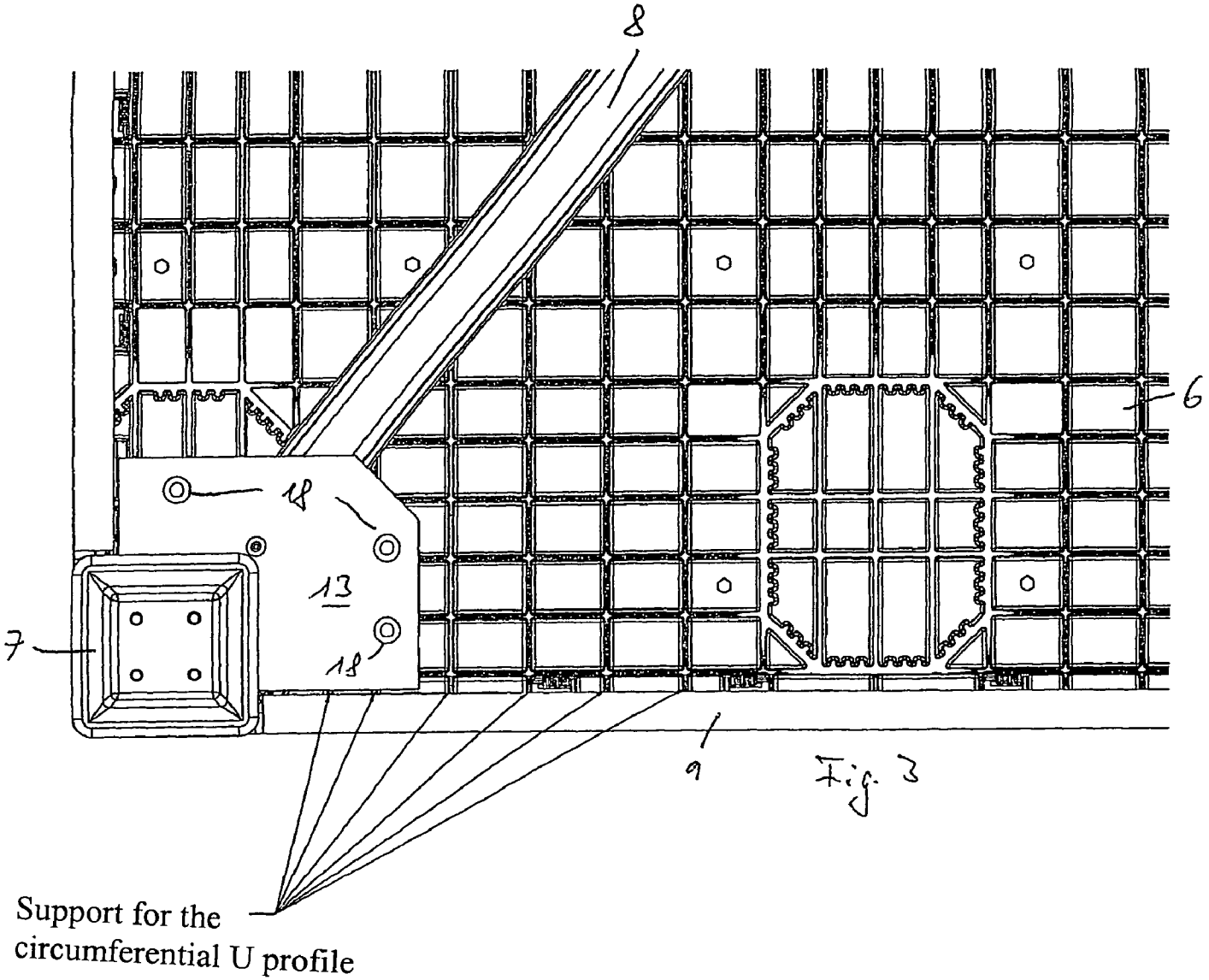
FIG. 3 detail according to FIG. 2

As is evident from FIG. 3, the U-profile strip 9 is supported by the crosspieces of the honeycomb-shaped bottom part 6 on its inside.

In FIG. 4, a standing foot 7 is shown in a perspective representation.

It consists of plastic, for example, and is produced in one piece, using the injection-molding method.

The standing foot 7 is composed of the actual foot part 10, a contact surface 13 that projects out beyond the foot part 10 on both sides 11 and 12. On the sides that lie opposite the projecting regions of the contact surface, there is an up-drawn right-angle border 14, on the shank end surfaces 15 of which pegs 16 are formed, which correspond to the U profile of the U-profile strips 9 in their cross-sectional area.

On the contact surface 13, a bracket-like elevation 17 is provided (in this case, also formed on), the longitudinal orientation of which corresponds to the diagonal between two corner points of the bottom region 6. This bracket 17, too, has a cross-sectional area that corresponds to the U profile of the reinforcement strip 8.

Figure 5:
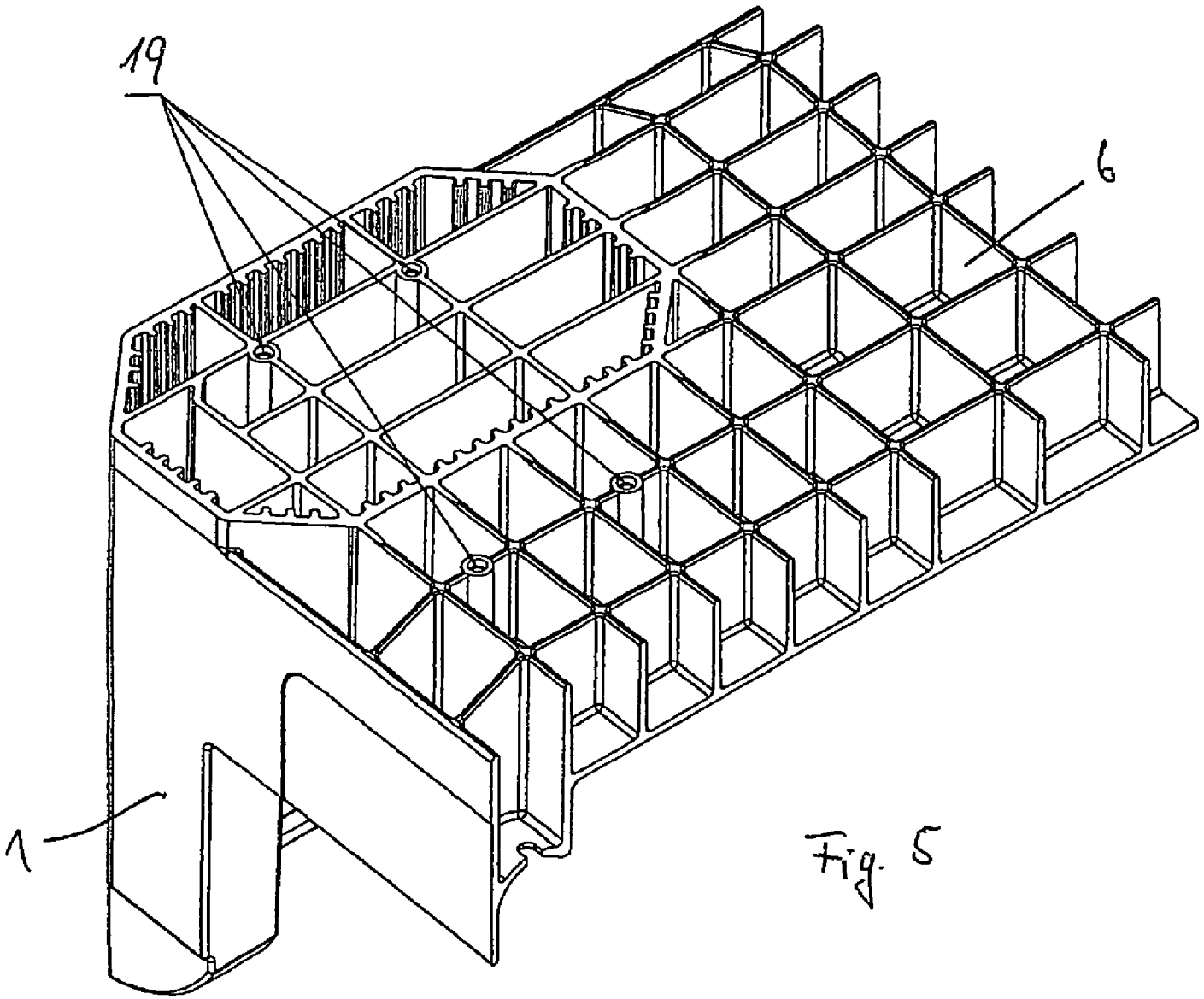
FIG. 5 bottom region of the container according to FIG. 2

In the contact surface 13, several bores 18 are provided, through which the self-tapping screws can be screwed into screw-on domes 19, which are situated in the honeycomb-like structure of the container bottom part 8 (see FIG. 5). In this manner, the standing feet 7 are attached to the corner regions of the container bottom part 8, after the U-profile strips 9 have been pushed onto the pegs 16, and also, the reinforcement strip 8 has been set onto the brackets 17 that lie diagonally opposite one another.

Figure 9:
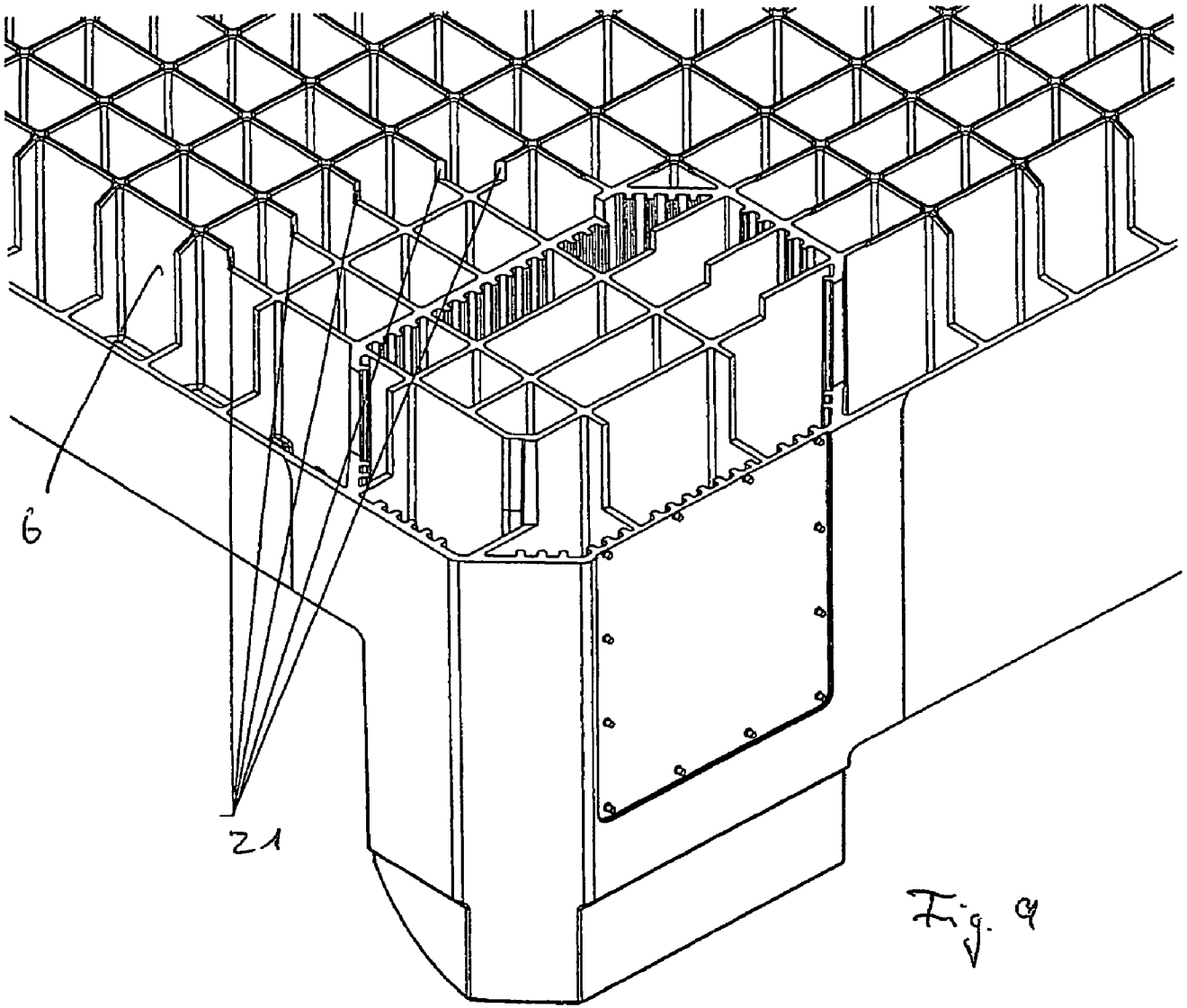

In FIG. 9, a corner region of the load carrier bottom 8 is shown, which is lowered at 21, corresponding to the thickness of the contact surface plate 13. In this way, this plate ends flush with the bottom surface, so that it is possible to move the forklift fork in without hindrance.

Figure 6:
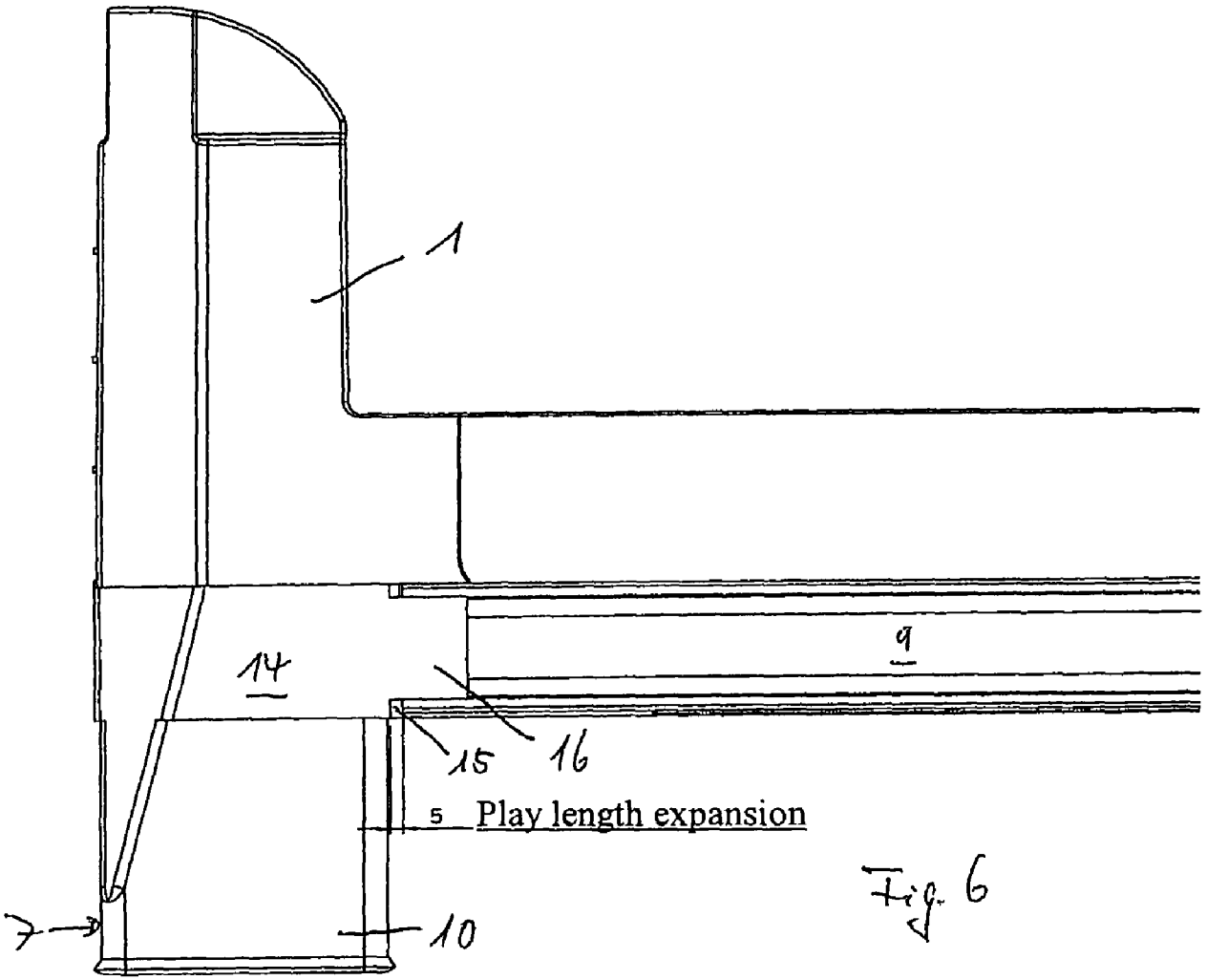
FIG. 6 lower part according to FIG. 2 in a side view and interrupted representation FIG. 7 pallet in a view from below FIG. 8 pallet according to FIG. 7 seen from above FIG. 9 detail from the load carrier bottom part

In FIG. 6, the lower part of a large space container 1 equipped in this manner is shown in a side view.

As is evident from FIG. 6, a play of 5 mm, in the present case, remains between the shank end surfaces 15 of the pegs 16 and the face surfaces of the U-profile strips 9 after feet 7 and U-profile strips 9 have been put together, to balance out the different length expansion values of plastic and metal due to temperature changes.

Figure 7:
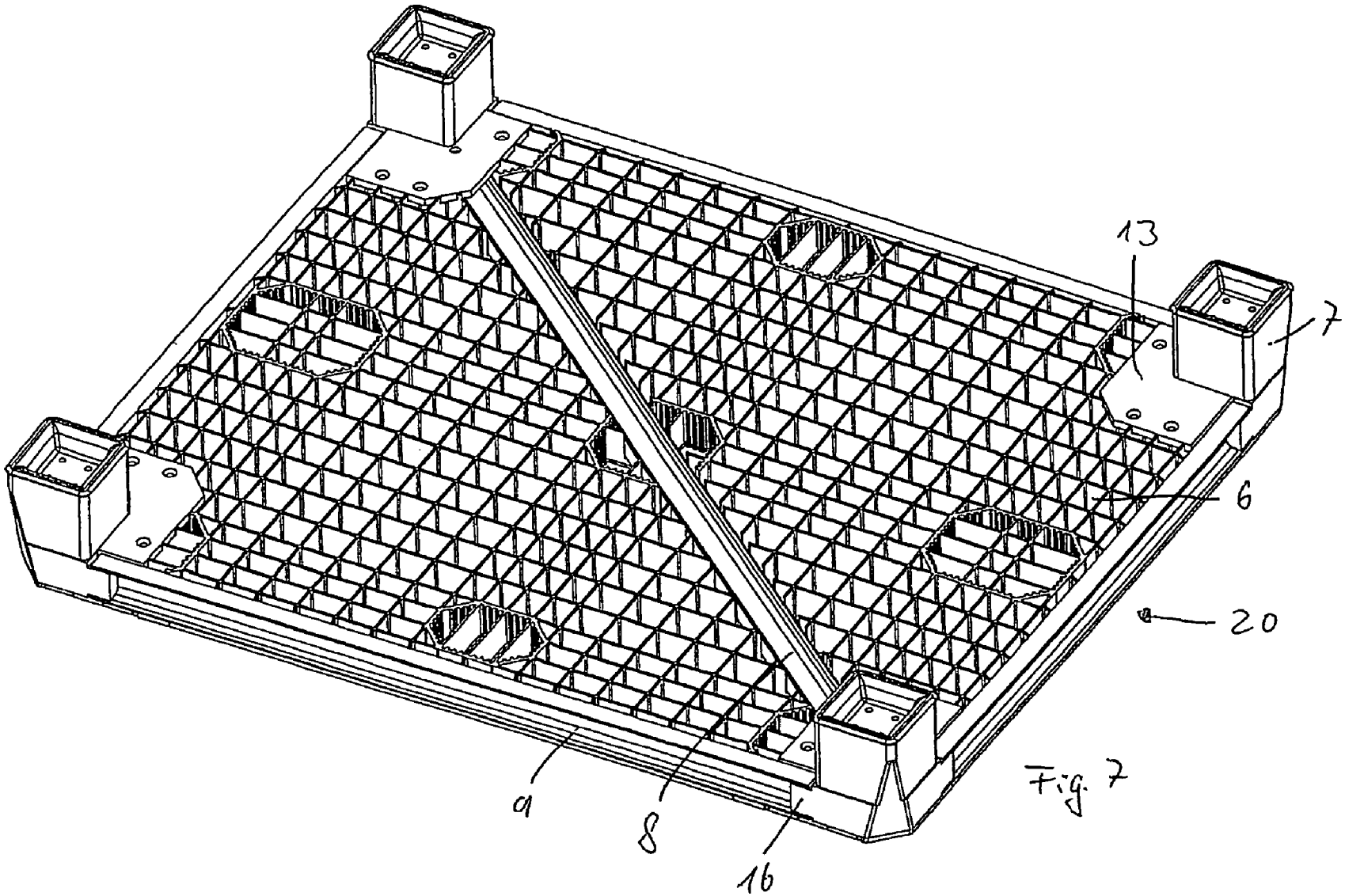
Figure 8:
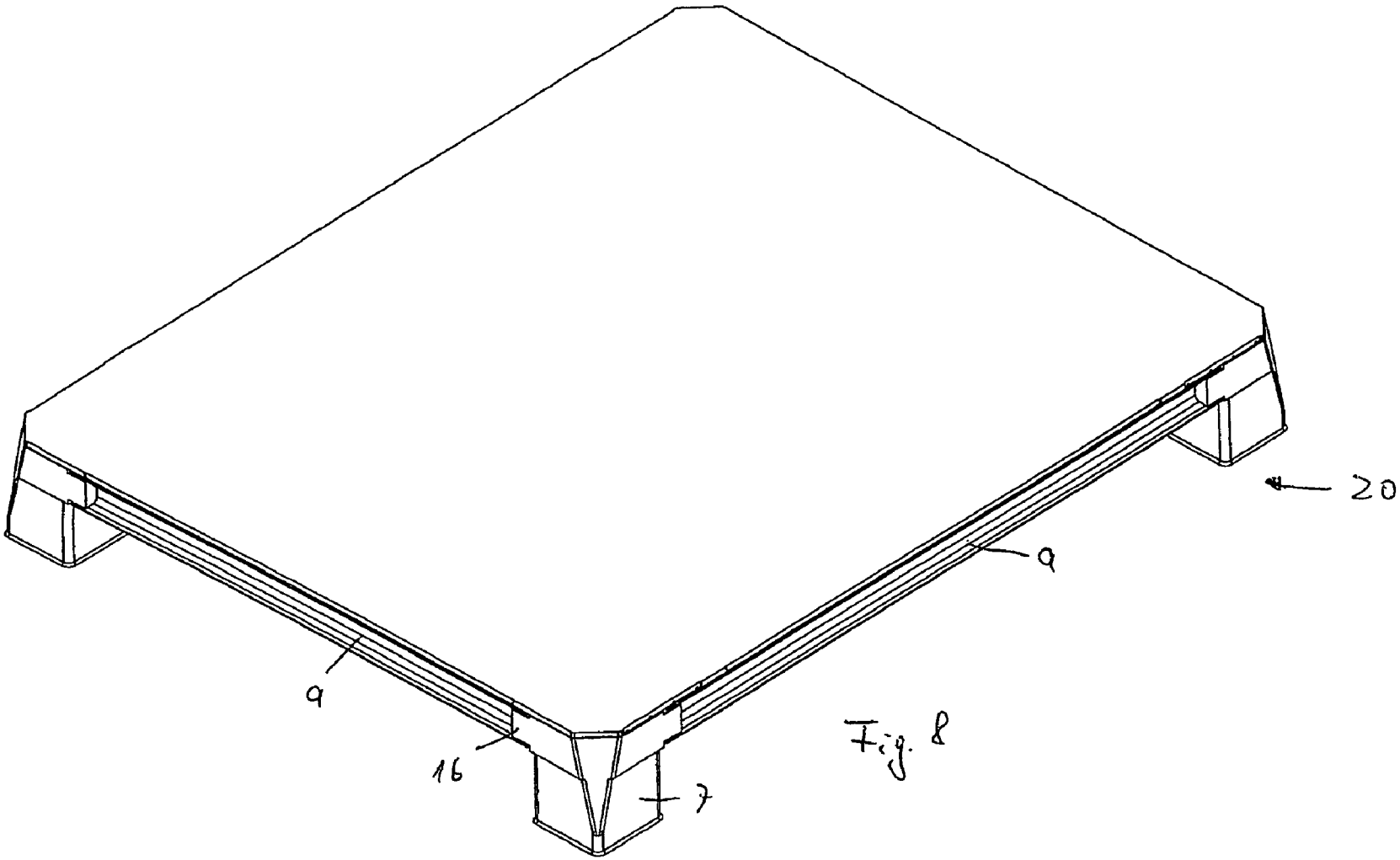

Such a modular system consisting of standing feet 7, U-profile rails 9, and reinforcement strips 8 is provided not only for the large space containers 1 just discussed, but rather can also be used in the case of the pallets 20 discussed farther above, as is evident from FIGS. 7 and 8.

Corresponding elements are designated with the same reference numbers as in FIGS. 1 to 6 in this drawing.

The invention claimed is:

1. Large load carrier made of plastic, comprising at least a rectangular bottom part having a foot part for the engagement of the fork of a forklift truck, having standing feet disposed at least at the four corner regions of the bottom part, between which metallic U-profile rails having a U-shaped opening that points outward are disposed along the lower edge of the load carrier, wherein the feet (7) can be releasably attached to the underside of the bottom part (6) of the load carrier (1), have a contact surface (13) for the corner regions of the bottom part (6), as well as a border (14) that rises vertically from the contact surface (13), which the border surrounds the load carrier edges at a right angle, on which pegs (16) for accommodating the U-profile rails (9) and fixing them in place are formed at free shank end surfaces (15) of said border;

an accommodation and fixation element (17) oriented in the direction of the load carrier bottom diagonal is provided on the contact surface (13) for a reinforcement rail (8) that reaches from one standing foot (7) to the diagonally opposite standing foot (7) and is recessed into a depression provided in the bottom part (6);

a play of several millimeters remains between the free shank end surfaces (15) and face surfaces of the U-profile rails (9); and a play of several millimeters remains between a wall of the border (14) that faces towards the load carrier, and a face surface of the reinforcement rail (8) assigned to this wall.

2. Large load carrier according to claim 1, wherein the standing feet (7) are plastic injection-molded parts.

3. Large load carrier according to claim 2, wherein each foot of the standing feet has a respective standing surface and a respective metal plate is mounted on each standing surface.

4. Large load carrier according to claim 1, wherein the standing feet (7) are made of metal.

5. Large load carrier according to claim 1, wherein the standing feet (7) can be screwed onto the underside of the bottom part (6).

6. Large load carrier according to claim 5, wherein the screw connection takes place through bores (18) in the contact surface (13) of the foot (7), the bores align with screw-on domes (19) formed into the bottom part (6).

7. Large load carrier according to claim 1, wherein the contact surface (13) below the bottom part (6) extends beyond the standing foot (10) itself.

8. Large load carrier according to claim 1, wherein it is a large space container.

9. Large load carrier according to claim 1, wherein it is a pallet (20).

10. Large load carrier according to claim 1, wherein the contact surface has a plate and in the corner regions, the bottom part (6) is lowered (21) by the thickness of the plate of the contact surface (13).

* * * * *

UNITED STATES PATENT AND TRADEMARK OFFICE

CERTIFICATE OF CORRECTION

PATENT NO. : 7,748,330 B2
APPLICATION NO. : 11/664966
DATED : July 6, 2010
INVENTOR(S) : Dubois et al.

It is certified that error appears in the above-identified patent and that said Letters Patent is hereby corrected as shown below:

In particular, in Column 4, line 54 (Line 13 of Claim 1), before "the border" please delete: "which".

Signed and Sealed this

Twenty-fourth Day of August, 2010

David J. Kappos

David J. Kappos
*Director of the United States Patent and Trademark Office*